US008991820B2

(12) United States Patent
Hongo et al.

(10) Patent No.: US 8,991,820 B2
(45) Date of Patent: Mar. 31, 2015

(54) PAPER CONVEYING APPARATUS, JAM DETECTION METHOD, AND COMPUTER-READABLE, NON-TRANSITORY MEDIUM

(71) Applicant: PFU Limited, Kahoku-shi, Ishikawa (JP)

(72) Inventors: Masanobu Hongo, Kahoku (JP); Tetsuo Funada, Kanazawa (JP); Nobuhisa Yamazaki, Kahoku-gun (JP)

(73) Assignee: PFU Limited, Kahoku-shi ( * ) Notice: Subject to any disclaimer, the term of this patent is extended or adjusted under 35 U.S.C. 154(b) by 0 days.

(21) Appl. No.: 13/963,920

(22) Filed: Aug. 9, 2013

(65) Prior Publication Data

US 2014/0077446 A1 Mar. 20, 2014

(30) Foreign Application Priority Data

Sep. 14, 2012 (JP) ..... 2012-203466

(51) Int. Cl.

*B65H 7/02* (2006.01)
*B65H 5/00* (2006.01)
*B65H 7/06* (2006.01)

(52) U.S. Cl.

CPC ..... *B65H 5/00* (2013.01); *B65H 2515/82* (2013.01); *B65H 7/06* (2013.01); *B65H 2511/528* (2013.01); *B65H 2553/30* (2013.01)
USPC ..... 271/265.01

(58) Field of Classification Search

CPC ..... B65H 43/04; B65H 2511/528; B65H 2515/82; B65H 2557/112
USPC ..... 271/265.01
See application file for complete search history.

(56) References Cited

U.S. PATENT DOCUMENTS

| | | | |
|---|---|---|---|
| 4,022,460 | A | 5/1977 | Pritchett |
| 6,314,054 | B1 | 11/2001 | Priebsch |
| 7,934,722 | B2 | 5/2011 | Namikawa |
| 8,567,777 | B2 | 10/2013 | Syracuse et al. |
| 8,585,050 | B2 | 11/2013 | Syracuse et al. |
| 8,657,285 | B2 | 2/2014 | Matsuoka et al. |
| 2003/0006550 | A1 | 1/2003 | Chujo et al. |

(Continued)

FOREIGN PATENT DOCUMENTS

| | | |
|---|---|---|
| JP | 57-169767 | 10/1982 |
| JP | 60-112547 | 6/1985 |

(Continued)

OTHER PUBLICATIONS

Office action mailed Jul. 9, 2013 for JP 2012-185273 including English translation, 7pp.

(Continued)

*Primary Examiner* — Michael McCullough
*Assistant Examiner* — Howard Sanders
(74) *Attorney, Agent, or Firm* — Christie, Parker & Hale, LLP

(57) ABSTRACT

There are provided a paper conveying apparatus, a jam detection method and a computer-readable, non-transitory medium that can suppress erroneous detection of a jam. The paper conveying apparatus includes a sound signal generator, provided with a sound detector near a conveyance path of a paper, for generating a sound signal, and a sound jam detector for determining whether a jam has occurred based on a variation of a component of the sound signal.

4 Claims, 16 Drawing Sheets

(56) References Cited

U.S. PATENT DOCUMENTS

| | | | | |
|---|---|---|---|---|
| 2005/0269759 | A1 | 12/2005 | Sano et al. | |
| 2006/0022400 | A1* | 2/2006 | Kawasaki et al. | 271/227 |
| 2007/0070456 | A1 | 3/2007 | Nishimura | |
| 2008/0224390 | A1* | 9/2008 | Ma et al. | 271/258.01 |
| 2009/0022536 | A1 | 1/2009 | Takeshita et al. | |
| 2009/0190939 | A1 | 7/2009 | Satoh et al. | |
| 2010/0272460 | A1 | 10/2010 | Zona et al. | |
| 2011/0238423 | A1 | 9/2011 | Schaertel et al. | |
| 2012/0235929 | A1 | 9/2012 | Hongo et al. | |
| 2013/0093136 | A1 | 4/2013 | Sakharshete et al. | |
| 2013/0140757 | A1 | 6/2013 | Phinney et al. | |
| 2013/0140766 | A1 | 6/2013 | Syracuse et al. | |
| 2014/0054841 | A1 | 2/2014 | Morikawa et al. | |
| 2014/0054844 | A1* | 2/2014 | Morikawa et al. | 271/18 |
| 2014/0054849 | A1 | 2/2014 | Morikawa et al. | |
| 2014/0054851 | A1 | 2/2014 | Morkiawa et al. | |
| 2014/0054852 | A1 | 2/2014 | Hongo et al. | |
| 2014/0061995 | A1 | 3/2014 | Shimazu | |
| 2014/0062008 | A1 | 3/2014 | Hongo et al. | |
| 2014/0062009 | A1 | 3/2014 | Hongo et al. | |
| 2014/0077445 | A1 | 3/2014 | Morikawa et al. | |
| 2014/0360275 | A1* | 12/2014 | Link et al. | 73/646 |

FOREIGN PATENT DOCUMENTS

| | | |
|---|---|---|
| JP | 61-169983 | 7/1986 |
| JP | 10-267742 | 10/1998 |
| JP | 11-053602 | 2/1999 |
| JP | 2001-302021 | 10/2001 |
| JP | 2002-205449 | 7/2002 |
| JP | 2003-295707 | 10/2003 |
| JP | 2006-322947 | 11/2006 |
| JP | 2007-079263 | 3/2007 |
| JP | 2008-290288 | 12/2008 |
| JP | 2009-249046 | 10/2009 |
| JP | 2011-112665 | 6/2011 |
| JP | 2012-131579 | 7/2012 |

OTHER PUBLICATIONS

Office action mailed Jul. 9, 2013 for JP 2012-185355 including English translation, 5pp.

Office action mailed Jul. 9, 2013 for JP 2012-185358 including English translation, 4pp.

Office action mailed Jul. 9, 2013 for JP 2012-185378 including English translation, 8pp.

Office action mailed Jul. 9, 2013 for JP 2012-203466 including English translation, 7pp.

Office action mailed Jul. 9, 2013 for JP 2012-203557 including English translation, 7pp.

* cited by examiner

PAPER CONVEYING APPARATUS, JAM DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-203466, filed on Sep. 14, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A detection apparatus of printed matter which determines that a bill is normal if the level of an output signal of a filter which passes only a signal of a frequency band which is set in advance according to the type of the paper currency is higher than a preset detection level and determines that a bill is damaged if the level is lower than that, has previously been disclosed (see Japanese Laid-Open Patent Publication No. 61-169983).

SUMMARY

In the past, the conveyance sound of a paper which has wrinkles sometimes caused it to be mistakenly determined that a jam had occurred.

Accordingly, it is an object of the present invention to provide a paper conveying apparatus and a jam detection method that can suppress mistaken detection of the occurrence of a jam and a computer-readable, non-transitory medium storing a computer program for causing a computer to implement such a jam detection method.

According to an aspect of the apparatus, there is provided a paper conveying apparatus. The paper conveying apparatus includes a sound signal generator, provided with a sound detector near a conveyance path of a paper, for generating a sound signal, and a sound jam detector for determining whether a jam has occurred based on a variation of a component of the sound signal.

According to an aspect of the method, there is provide a jam detection method. The jam detection method includes acquiring a sound signal, and determining, by a computer, whether a jam has occurred based on a variation of a component of the sound signal.

According to an aspect of the computer-readable, non-transitory medium storing a computer program, the computer program causes a computer to execute a process, including acquiring a sound signal, and determining whether a jam has occurred based on a variation of a component of the sound signal.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection, and computer program according to an embodiment, will be described with reference to the drawings. However, note that the technical scope of the invention is not limited to these embodiments and extends to the inventions described in the claims and their equivalents.

Figure 1:
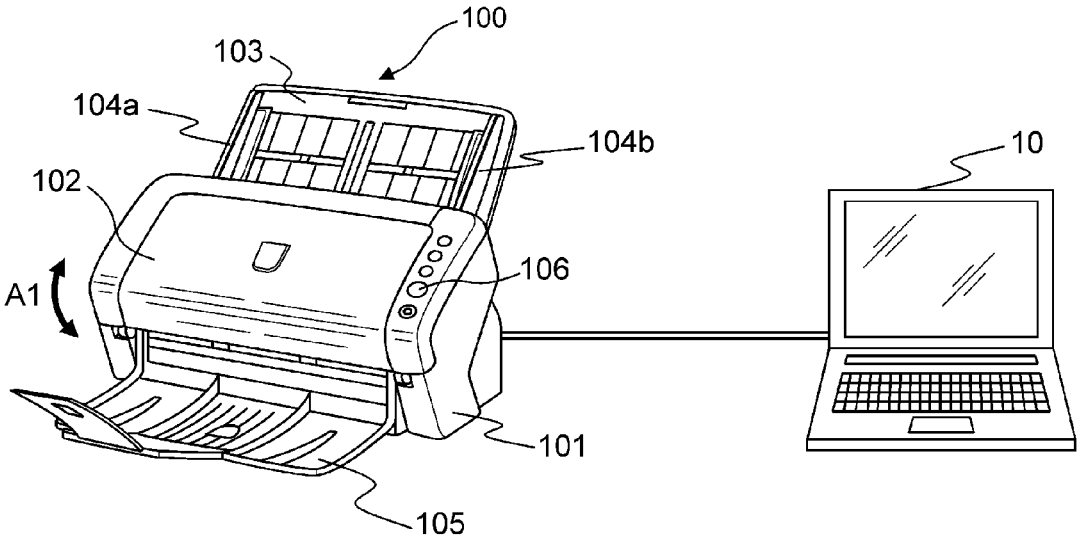
FIG. 1 is a perspective view which shows a paper conveying apparatus 100 and image processing apparatus 10 according to an embodiment.

FIG. 1 is a perspective view which shows a paper conveying apparatus 100 which are configured as an image scanner, and an information processing apparatus 10, according to an embodiment.

The paper conveying apparatus 100 includes a lower housing 101, an upper housing 102, a paper tray 103, an ejection tray 105, an operation button 106, etc., and is connected to an information processing apparatus (for example, personal computer, portable data terminal, etc.)

The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
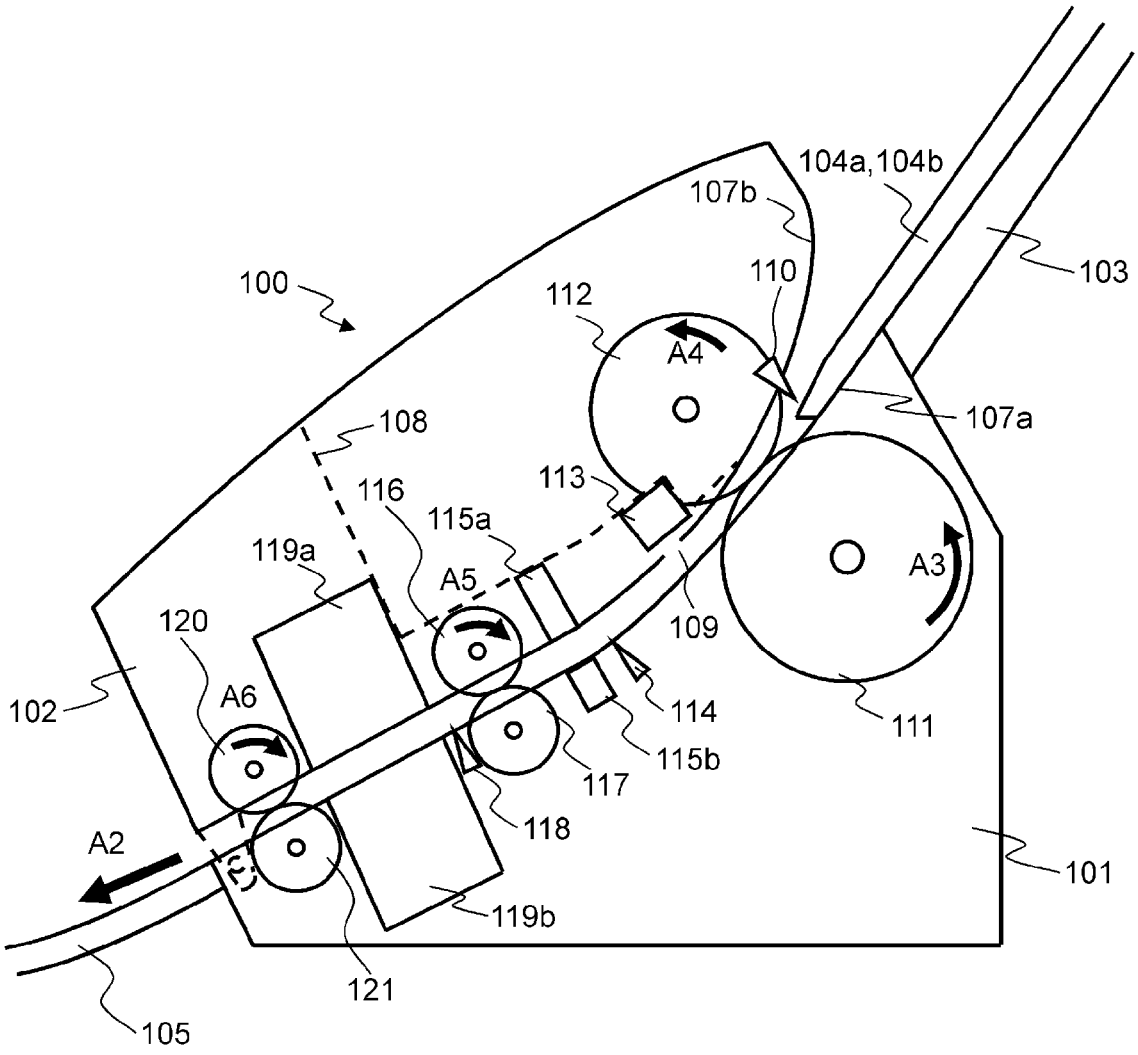
FIG. 2 is a view for explaining an example of a conveyance route at an inside of a paper conveying apparatus 100.

FIG. 2 is a view for explaining an example of the conveyance route at the inside of the paper conveying apparatus 100.

The conveyance route at the inside of the paper conveying apparatus 100 has a first paper detector 110, a paper feed roller 111, a retard roller 112, a microphone 113, a second paper detector 114, an ultrasonic transmitter 115*a*, an ultrasonic receiver 115*b*, a first conveyor roller 116, a first driven roller 117, a third paper detector 118, a first image capture unit 119*a*, a second image capture unit 119*b*, a second conveyor roller 120, a second driven roller 121, etc.

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The microphone 113 is an example of a sound detector, is provided near a conveyance path of a paper, and detects the sound generated by a paper during conveyance of the paper, and generates and outputs an analog signal corresponding to the detected sound. The microphone 113 is arranged at the downstream side of the paper feed roller 111 and the retard roller 112 while fastened to the frame 108 at the inside of the upper housing 102. Note that, to enable the sound when papers are separated at the paper feed roller 111 and retard roller 112 to be detected better, the microphone 113 is preferably provided near to the paper feed roller 111 and retard roller 112 from near a side wall of the paper conveyance path. A hole 109 is provided in the upper guide 107*b* facing the microphone 113, so that the sound generated by the paper during conveyance of the paper can be more accurately detected by the microphone 113.

The second paper detector 114 has a contact detection sensor which is arranged at a downstream side of the paper feed roller 111 and the retard roller 112 and at an upstream side of the first conveyor roller 116 and first driven roller 117 and detects if there is a paper present at that position. The second paper detector 114 generates and outputs a second paper detection signal which changes in signal value between a state at which there is a paper at that position and a state where there is no paper there.

The ultrasonic transmitter 115*a* and the ultrasonic receiver 115*b* are an example of an ultrasonic detector, and are arranged near the conveyance path of the paper so as to face each other across the conveyance path. The ultrasonic transmitter 115*a* transmits an ultrasonic wave. On the other hand, the ultrasonic receiver 115*b* detects an ultrasonic wave which is transmitted by the ultrasonic transmitter 115*a* and passes through the paper or papers, and generates and outputs an ultrasonic signal comprised of an electrical signal corresponding to the detected ultrasonic wave. Below, the ultrasonic transmitter 115*a* and the ultrasonic receiver 115*b* will sometimes be referred to altogether as the "ultrasonic sensor 115".

The third paper detector 118 has a contact detection sensor which is arranged at a downstream side of the first conveyor roller 116 and the first driven roller 117 and an upstream side of the first image capture unit 119*a* and the second image capture unit 119*b* and detects if there is a paper at that position. The third paper detector 118 generates and outputs a third paper detection signal which changes in signal value between a state where there is a paper at that position and a state where there is no such paper there.

The first image capture unit 119*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 119*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 119*a* and the second image capture unit 119*b* and read only one surface of the paper. Further, instead of a CIS, it is also possible to utilize an image capturing sensor of a reduced magnification optical system type using CCD's (charge coupled devices). Below, the first image capture unit 119*a* and the second image capture unit 119*b* will sometimes be referred to overall as the "image capture units 119".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 116 and the first driven roller 117 while being guided by the lower guide 107*a* and the upper guide 107*b*. The paper is sent between the first image capture unit 119*a* and the second image capture unit 119*b* by the first conveyor roller 116 rotating in the direction of the arrow mark A5 of FIG. 2. The paper which is read by the image capture unit 119 is ejected onto the ejection tray 105 by the second conveyor roller 120 rotating in the direction of the arrow mark A6 of the FIG. 2.

Figure 3:
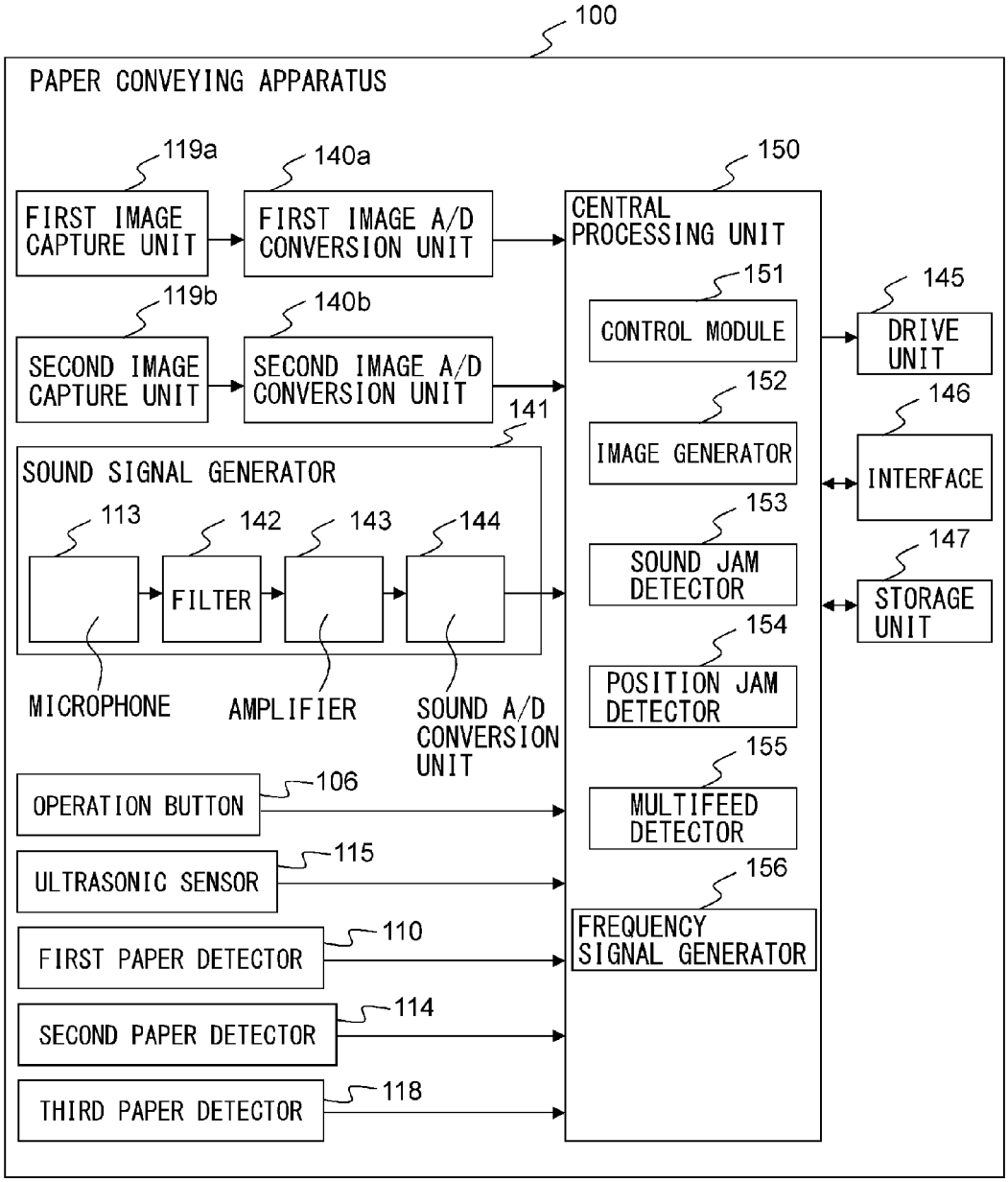
FIG. 3 is an example of a block diagram which shows a schematic configuration of a paper conveying apparatus 100.

FIG. 3 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a sound signal generator 141, a drive unit 145, an interface 146, a storage unit 147, a central processing unit 150, etc.

The first image A/D conversion unit 140*a* converts an analog image signal which is output from the first image capture unit 119*a* from an analog to digital format to generate digital image data which it then outputs to the central processing unit 150. Similarly, the second image A/D conversion unit 140*b* converts the analog image signal which is output from the second image capture unit 119*b* from an analog to digital format to generate digital image data which it then outputs to the central processing unit 150. Below, these digital image data will be referred to as the "read image".

The sound signal generator 141 includes a microphone 113, a filter 142, an amplifier 143, a sound A/D conversion unit 144, etc., and generates a sound signal. The filter 142 applies a bandpass filter which passes a predetermined frequency band of a signal to an analog signal which is output from the microphone 113 and outputs it to the amplifier 143. The amplifier 143 amplifies the signal which is output from the filter 142 and outputs it to the sound A/D conversion unit 144. The sound A/D conversion unit 144 converts the analog signal which is output from the amplifier 143 to a digital signal and outputs it to the central processing unit 150. Below, a signal which is output by the sound signal generator 141 will be referred to as a "sound signal".

Note that, the sound signal generator 141 is not limited to this. The sound signal generator 141 may include only the microphone 113, while the filter 142, the amplifier 143, and the sound A/D conversion unit 144 may be provided outside of the sound signal generator 141. Further, the sound signal generator 141 may include only the microphone 113 and the filter 142 or only the microphone 113, the filter 142, and the amplifier 143.

The drive unit 145 includes one or more motors and uses control signals from the central processing unit 150 to rotate the paper feed roller 111, the retard roller 112, the first conveyor roller 116, and the second conveyor roller 120 and operate to convey a paper.

The interface 146 has, for example, a USB or other serial bus-based interface circuit and electrically connects with the information processing apparatus 10 to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read images.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, second paper detector 114, ultrasonic sensor 115, third paper detector 118, first image capture unit 119*a*, second image capture unit 119*b*, first image A/D conversion unit 140*a*, second image A/D conversion unit 140*b*, sound signal generator 141, drive unit 145, interface 146, and storage unit 147 and controls these units.

The central processing unit 150 control a drive operation of the drive unit 145, control a paper read operation of the image capture unit 119, etc., to acquire a read image. Further, the central processing unit 150 has a control module 151, an image generator 152, a sound jam detector 153, a position jam detector 154, a multifeed detector 155, a frequency signal generator 156, etc. These units are functional modules which are realized by software which operate on a processor. Note that, these units may be comprised of respectively independent integrated circuits, a microprocessor, firmware, etc.

Figure 4:
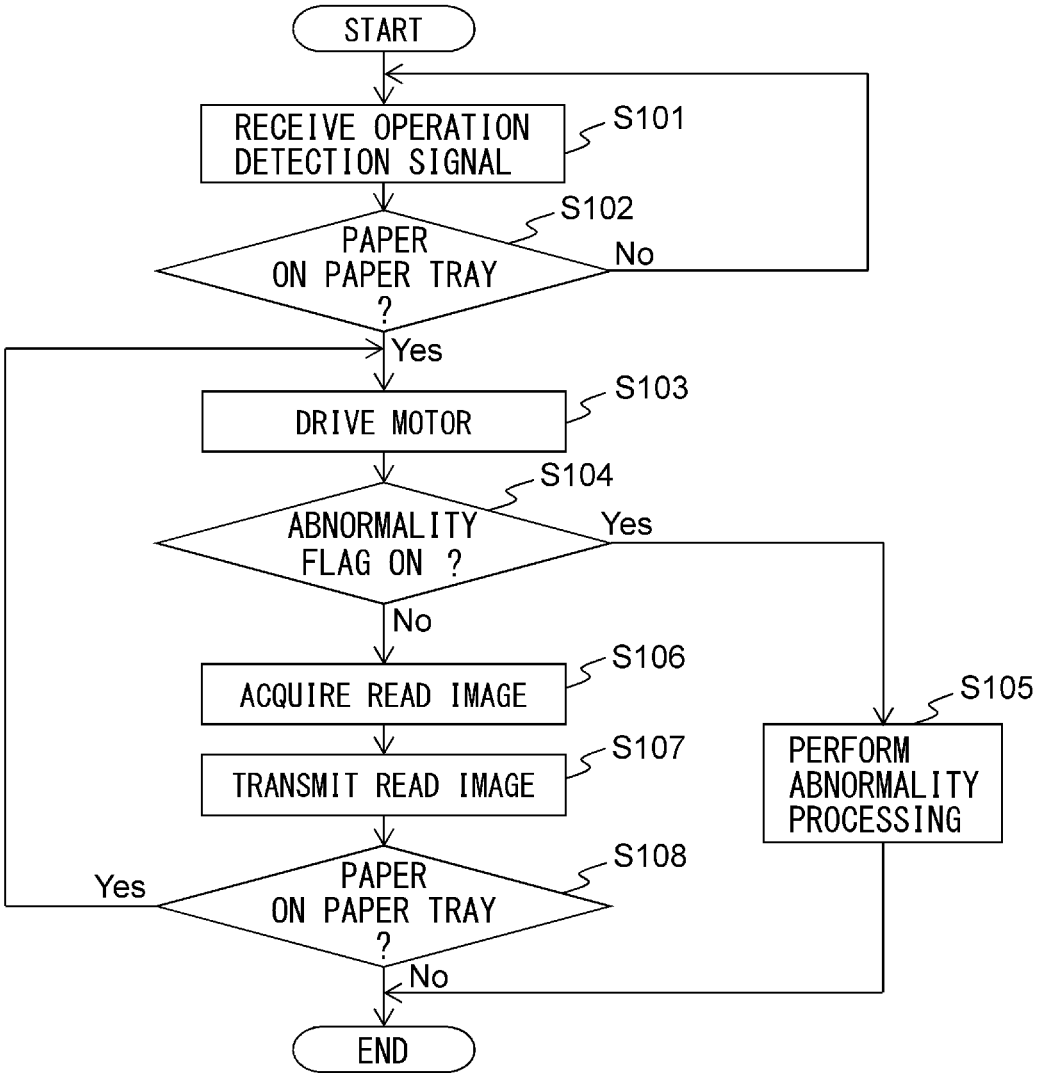
FIG. 4 is a flow chart which shows an example of operation of overall processing of a paper conveying apparatus 100.

FIG. 4 is a flow chart which shows an example of operation of overall processing of the paper conveying apparatus 100.

Below, referring to the flow chart which is shown in FIG. 4, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 116, and second conveyor roller 121 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 119*a* and the second image capture unit 119*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 determine whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 5:
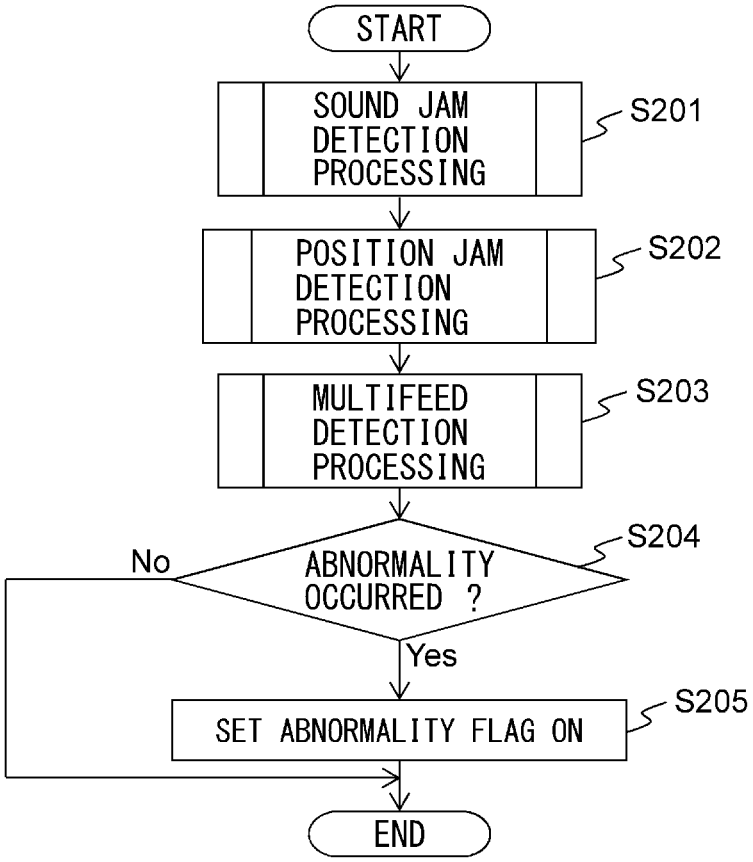
FIG. 5 is a flow chart which shows an example of an abnormality detection of the paper conveyance.

FIG. 5 is a flow chart which shows an example of an abnormality detection of the paper conveyance of the paper conveying apparatus 100.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). In the sound jam detection processing, the sound jam detector 153 determines whether a jam has occurred based on a variation of a component of a sound signal which is acquired from the sound signal generator 141. The variation of the component of the sound signal means the magnitude of variation between specific components in a sound signal. Below, sometimes a jam which is determined to exist by the sound jam detector 153 based on a variation of a component of a sound signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 114 and the third paper detection signal which is acquired from the third paper detector 118. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 116. Details of the multifeed detection processing will be explained later.

Next, the control module 151 determines whether an abnormality has occurred in the paper conveyance processing (step S204). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 6:
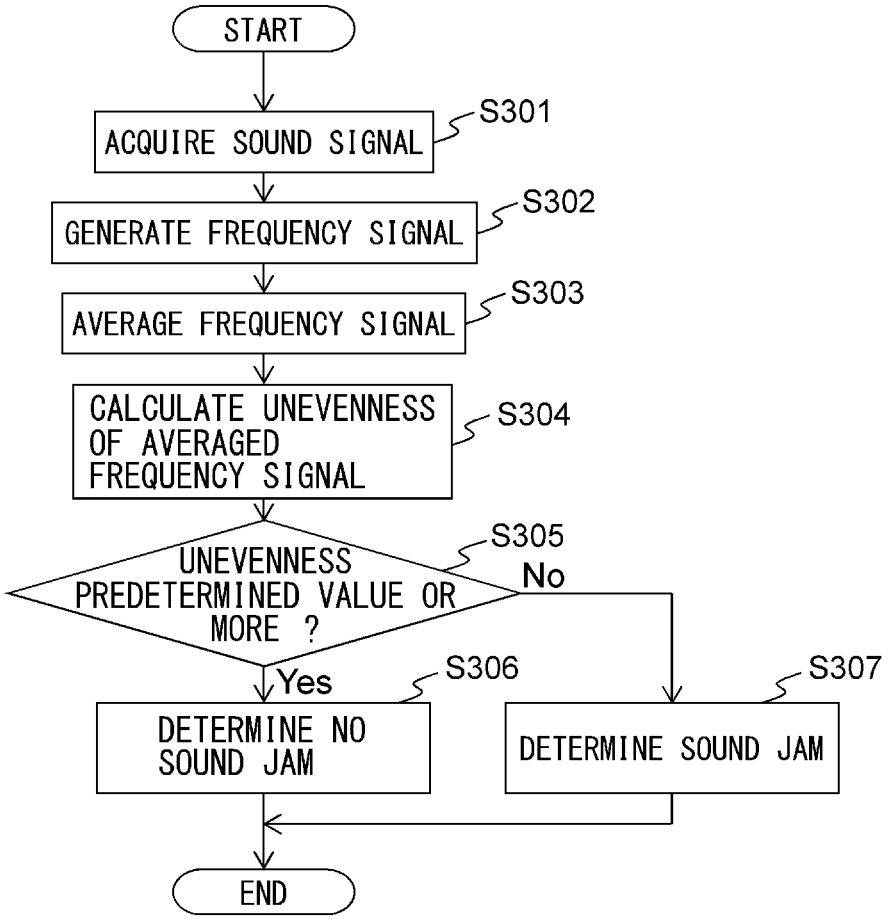
FIG. 6 is a flow chart which shows an example of operation of sound jam detection processing.

FIG. 6 is a flow chart which shows an example of operation of a sound jam judgment processing.

The flow of operation which is shown in FIG. 6 is executed at step S201 of the flow chart which is shown in FIG. 5.

First, the frequency signal generator 156 acquires a sound signal from the sound signal generator 141 (step S301).

Next, the frequency signal generator 156 generates a frequency signal which is acquired by using a fast Fourier transform (FFT) to convert the sound signal which is acquired from the sound signal generator 141 to frequency (step S302).

The sound A/D conversion unit 144 samples an analog signal which is output by the amplifier 143 at 22 kHz to convert it to a digital format and generate a sound signal. The frequency signal generator 156 acquires 1024 samples worth (46 msec worth) of the sound signal and samples it at 100 Hz to 600 Hz in range at 21.5 Hz intervals to acquire a signal converted to frequency. The frequency signal generator 156 converts the signal acquired by converting the sound signal to frequency to decibels based on the maximum possible volume so as to generate the frequency signal.

Figure 7:
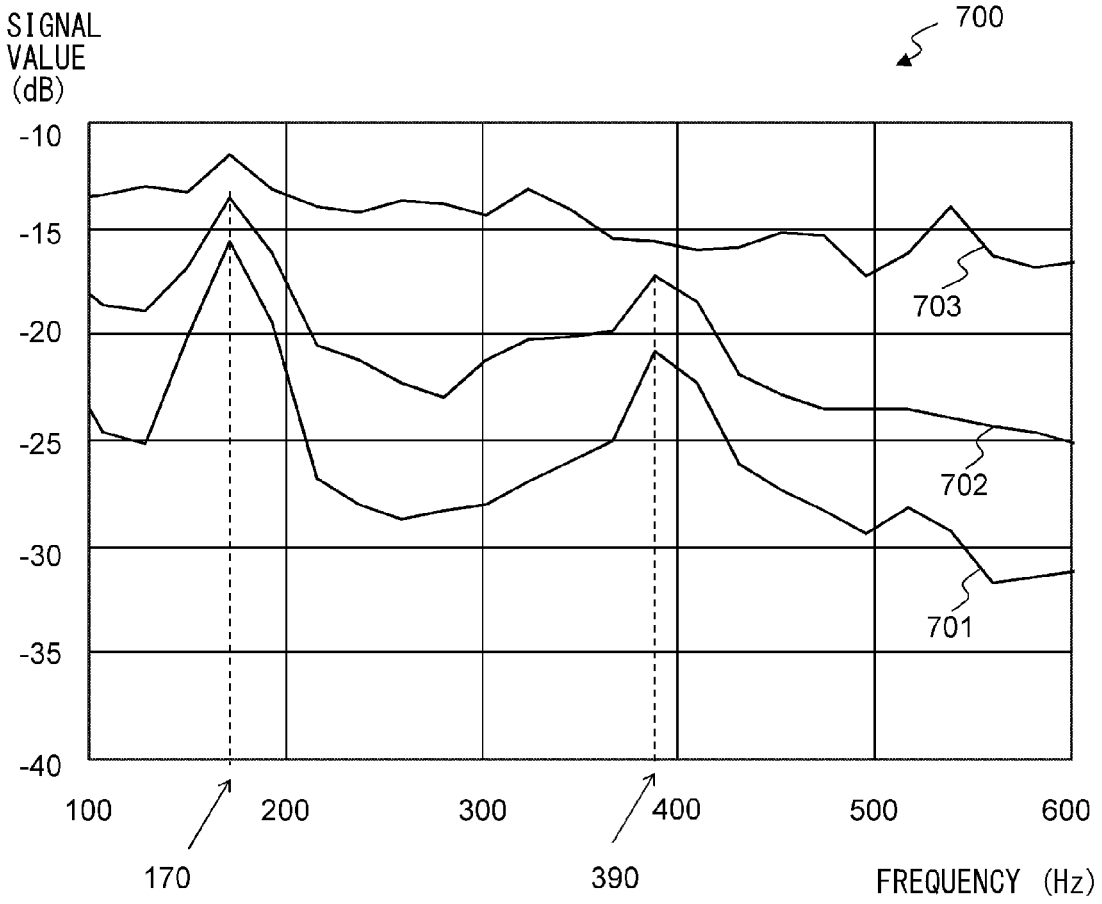
FIG. 7 is a graph which shows an example of a frequency signal.

FIG. 7 is a graph which shows an example of frequency signals. In FIG. 7, the abscissa shows the frequency, while the ordinate shows the signal value of the frequency signal. The graph 700 of FIG. 7 shows an example of a frequency signal 701 when a normal paper which does not have wrinkles (below, called "normal paper") is conveyed, a frequency signal 702 when a paper which has wrinkles (below, called "wrinkled paper") is conveyed, and a frequency signal 703 when a jam occurs.

As shown in FIG. 7, at the frequency signal 701 when normal paper is conveyed and the frequency signal 702 when wrinkled paper is conveyed, components of specific frequencies (170 Hz and 390 Hz) become larger than the components of other frequencies. On the other hand, in the frequency signal 703 when a jam occurs, the component of a specific frequency is not larger than the components of other frequencies as much as in the frequency signal 701 and frequency signal 702.

Next, the sound jam detector 153 averages a plurality of values of the frequency signal which is generated by the frequency signal generator 156 at predetermined time periods to generate an averaged frequency signal (step S303). The sound jam detector 153 averages the signal values at frequencies at 21.5 Hz intervals in six samples worth (276 msec worth) of the frequency signal to generate the averaged frequency signal. The sound jam detector 153 can average the frequency signal to thereby acquire stable results of detection in sound jam detection processing.

Next, the sound jam detector 153 calculates, as the fluctuation of a component of the sound signal, an unevenness of the frequency signal, that is, an unevenness of a frequency component of the sound signal (step S304). The unevenness means the degree of change between specific components.

The sound jam detector 153 calculates the sum of the differences between the values of the frequency components at the averaged frequency signal and the values of the adjoining frequency components which respectively adjoin the frequency components as the unevenness of the frequency signal. The sound jam detector 153 calculates, for each frequency at 21.5 Hz intervals, the absolute value of the difference between the value of the averaged frequency signal at that frequency and the value of the averaged frequency signal at a frequency adjoining that frequency (frequency 21.5 Hz higher than that frequency). The sound jam detector 153 calculates the total sum of the absolute values of the differences which were calculated for each frequency of 100 Hz to 600 Hz as the unevenness of the frequency signal.

Next, the sound jam detector 153 determines whether the calculated unevenness is a predetermined value or more (step S305). The predetermined value is set, by advance experiments, to a value which enables the unevenness when a jam occurs and the unevenness when no jam has occurred to be differentiated. In the present example, it is made 24.

Next, the sound jam detector 153 determines that no sound jam has occurred when the unevenness is a predetermined value or more (step S306) and determines that a sound jam has occurred when the unevenness is less than the predetermined value (step S307), then the series of steps is ended.

In the example which is shown in FIG. 7, the unevenness of the frequency signal 701 becomes 45 and the unevenness of the frequency signal 702 becomes 28, so for the frequency signal 701 and frequency signal 702, it is determined that no sound jam has occurred. On the other hand, the unevenness of the frequency signal 703 becomes 19, so for the frequency signal 703, it is determined that a sound jam has occurred.

Note that, at step S304, the sound jam detector 153 may calculate the deviation of unevenness of the frequency signal from the difference of the average values of the averaged frequency signal at adjoining frequency bands. In this case, the sound jam detector 153 divides the 100 Hz to 600 Hz frequency band into frequency bands of 64.5 Hz bandwidths including three frequencies at 21.5 Hz intervals. The sound jam detector 153 calculates, for each divided frequency band, the absolute value of the difference between the average value of the averaged frequency signal at that frequency band and the average value of the averaged frequency signal at a frequency band which adjoins that frequency bands. The sound jam detector 153 calculates the sum of the absolute values of the differences which were calculated for the respective frequency bands divided between 100 Hz and 600 Hz as the unevenness of the frequency signal.

Further, at step S304, the sound jam detector 153 may calculate the difference between the maximum value of the averaged frequency signal at 100 Hz to 600 Hz and the average value of the averaged frequency signal as the unevenness of the frequency signal. The predetermined value in this case may be made 5.

When calculating the difference between the maximum value of the averaged frequency signal at 100 Hz to 600 Hz and the average value of the averaged frequency signal as the unevenness of the frequency signal, in the example which is shown in FIG. 7, the unevenness of the frequency signal 701 becomes 10 and the unevenness of the frequency signal 702 becomes 7. Therefore, for the frequency signal 701 and frequency signal 702, it is determined that no sound jam occurs. On the other hand, the unevenness of the frequency signal 703 becomes 3, so for the frequency signal 703, it is determined that a sound jam has occurred.

Further, at step S304, the sound jam detector 153 may calculate the difference of the maximum value of the averaged frequency signal at 100 Hz to 600 Hz and the minimum value of the averaged frequency signal as the unevenness of the frequency signal. The predetermined value in this case may be made 9.

When calculating the difference of the maximum value of the averaged frequency signal at 100 Hz to 600 Hz and the minimum value of the averaged frequency signal as the unevenness of the frequency signal, in the example which is shown in FIG. 7, the unevenness of the frequency signal 701 becomes 16 and the unevenness of the frequency signal 702 becomes 11. Therefore, for the frequency signal 701 and frequency signal 702, it is determined that no sound jam has occurred. On the other hand, the unevenness of the frequency signal 703 becomes 6, so for the frequency signal 703, it is determined that a sound jam has occurred.

Further, at step S304, the sound jam detector 153 may calculate the difference of the signal value of the averaged frequency signal at a predetermined frequency (170 Hz) and the average value of the averaged frequency signal as the unevenness of the frequency signal.

Further, at step S304, the sound jam detector 153 may calculate the difference of the signal value of the averaged frequency signal at a predetermined frequency (170 Hz) and the minimum value of the averaged frequency signal as the unevenness of the frequency signal.

Further, at step S304, the sound jam detector 153 may calculate the unevenness of the frequency signal not from the averaged frequency signal, but from the frequency signal itself.

Regarding calculation of the unevenness, the values of the sampling frequency of the sound signal, the range of the frequency generating the frequency signal, the interval of frequencies which are sampled (resolution of frequency signal), etc., are not limited to the above-mentioned values and can be suitably changed. Further, the values of the number of frequency signals for generation of the averaged frequency signal, the predetermined value for comparison with the unevenness, the numbers of frequencies inside the respective divided frequency bands when dividing a frequency band, the predetermined frequency, etc., are not limited to the above-mentioned values and can be suitably changed. Further, the frequency signal may be made a signal which expresses the absolute quantity not converted to decibels.

When a plurality of papers are conveyed, when the papers are separated at the paper feed roller 111 and retard roller 112, the papers rub against each other to thereby generate a rubbing sound. In the frequency signal which is generated from the sound signal at that time, due to this rubbing sound, specific frequency components will become larger than the other frequency components. On the other hand, if a jam occurs, the sound which is generated due to that jam masks that rubbing sound, so in the frequency signal which is generated from the sound signal at that time, no specific frequency components become larger than other frequency components as much as in a frequency signal when no jam has occurred. Therefore, as explained above, by utilizing the unevenness of a frequency signal, it is possible to precisely determine whether a jam has occurred.

Figure 8:
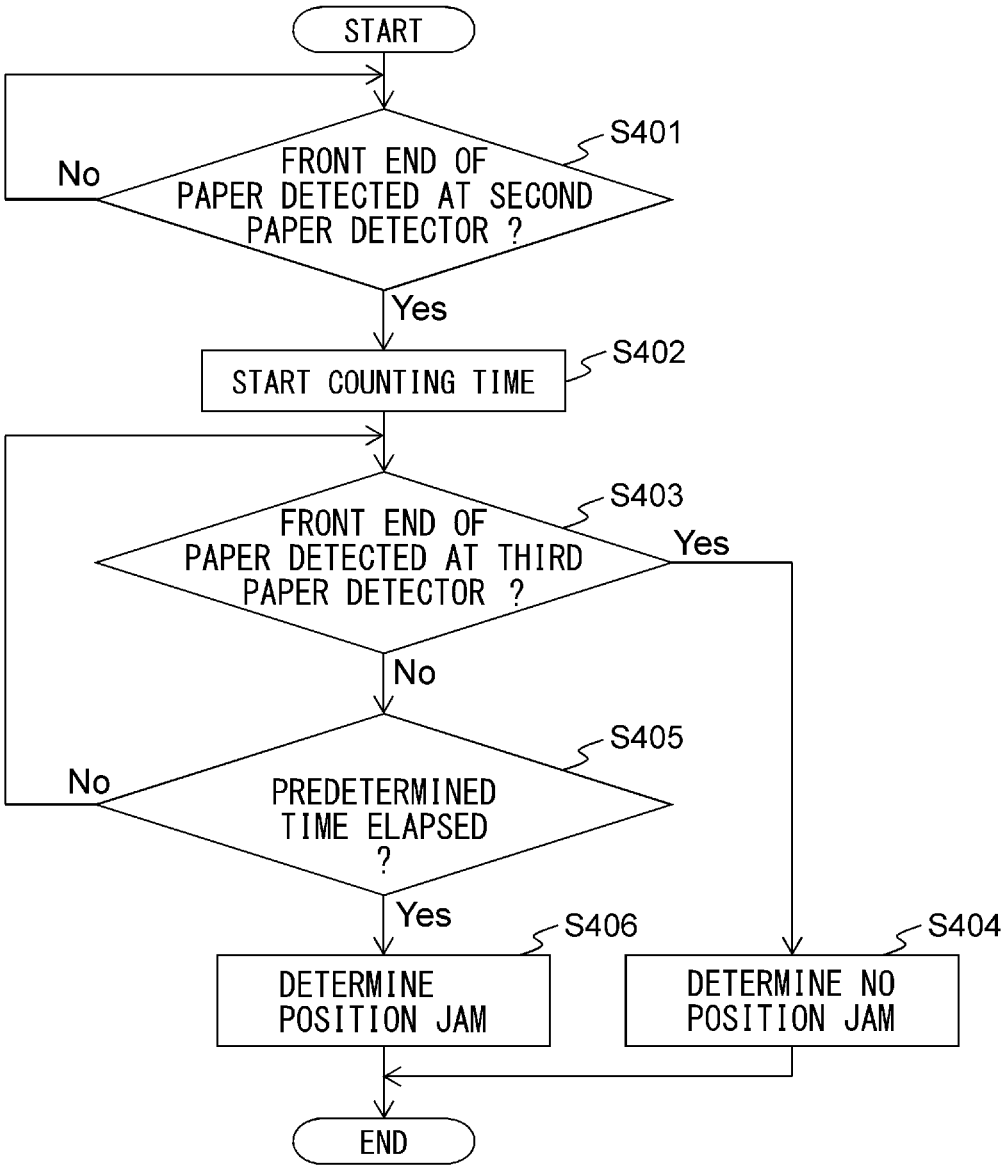
FIG. 8 is a flow chart which shows an example of operation of position jam detection processing.

FIG. 8 is a flow chart which shows an example of operation of a position jam detection processing.

The flow of operation which is shown in FIG. 8 is executed at step S202 of the flow chart which is shown in FIG. 5.

First, the position jam detector 154 stands by until the front end of the paper is detected by the second paper detector 114 (step S401). The position jam detector 154 determines that the front end of the paper is detected at the position of the second paper detector 114, that is, downstream of the paper feed roller 111 and retard roller 112 and upstream of the first conveyor roller 116 and first driven roller 117, when the value of the second paper detection signal from the second paper detector 114 changes from a value which shows the state where there is no paper to a value which shows the state where there is one.

Next, when the second paper detector 114 detects the front end of a paper, the position jam detector 154 starts counting time (step S402).

Next, the position jam detector 154 determines whether the third paper detector 118 has detected the front end of the paper (step S403). The position jam detector 154 determines that the front end of the paper is detected at the position of the third paper detector 118, that is, downstream of the first conveyor roller 116 and first driven roller 117 and upstream of the image capture unit 119, when the value of the third paper detection signal from the third paper detector 118 changes from a value which shows the state where there is no paper to a value which shows the state where there is one.

When the third paper detector 118 detects the front end of a paper, the position jam detector 154 determines that no position jam has occurred (step S404) and ends the series of steps.

On the other hand, if the third paper detector 118 detects the front end of the paper, the position jam detector 154 determines whether a predetermined time (for example, 1 second) has elapsed from the start of counting time (step S405). If a predetermined time has not elapsed, the position jam detector 154 returns to the processing of step S403 and again determines whether the third paper detector 118 has detected the front end of the paper. On the other hand, when a predetermined time has elapsed, the position jam detector 154 determines that position jam has occurred (step S406) and ends the series of steps. Note that, when position jam detection processing is not required in the paper conveying apparatus 100, this may be omitted.

Note that, when the central processing unit 150 detects that the front end of a paper is downstream of the first conveyor roller 116 and the first driven roller 117 by the third paper detection signal from the third paper detector 118, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 114, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 118 does not detect the front end of a paper within a predetermined time.

Figure 9:
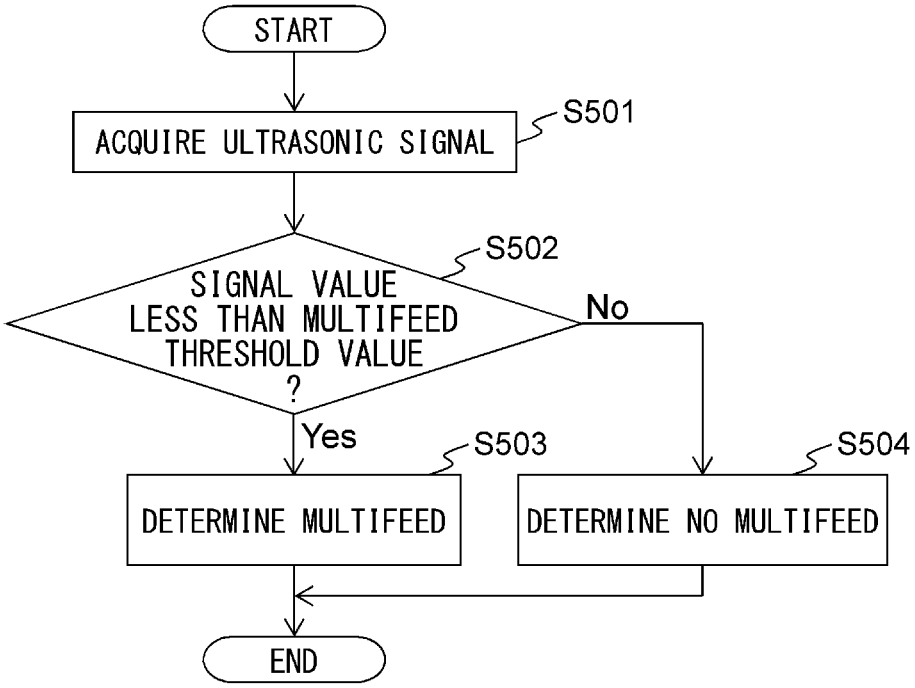
FIG. 9 is a flow chart which shows an example of operation of multifeed detection processing.

FIG. 9 is a flow chart which shows an example of operation of multifeed detection processing.

The flow of operation which is shown in FIG. 9 is executed at step S203 of the flow chart which is shown in FIG. 5.

First, the multifeed detector 155 acquires an ultrasonic signal from the ultrasonic sensor 115 (step S501).

Next, the multifeed detector 155 determines whether the signal value of the acquired ultrasonic signal is less than the multifeed detection threshold value (step S502).

Figure 10:
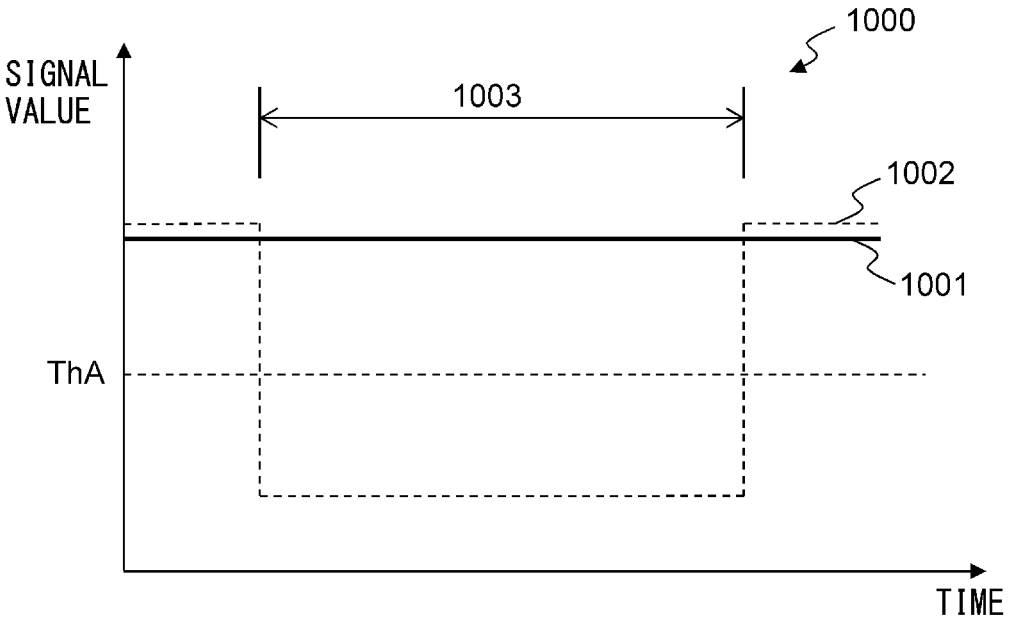
FIG. 10 a view for explaining properties of an ultrasonic signal.

FIG. 10 is a view for explaining properties of an ultrasonic signal.

In the graph 1000 of FIG. 10, the solid line 1001 shows the characteristic of the ultrasonic signal in the case where a single paper is conveyed, while the broken line 1002 shows the characteristic of the ultrasonic signal in the case where multifeed of papers has occurred. The abscissa of the graph 1000 shows the time, while the ordinate shows the signal value of the ultrasonic signal. Due to the occurrence of multifeed, the signal value of the ultrasonic signal of the broken line 1002 falls in the section 1003. For this reason, it is possible to determine whether multifeed of papers has occurred by whether the signal value of the ultrasonic signal is less than the multifeed detection threshold value ThA.

On the other hand, the solid line 1004 shows the characteristic of the ultrasonic signal in the case where just one plastic card thicker than paper is conveyed. When a card is conveyed, the signal value of the ultrasonic signal becomes smaller than the multifeed detection threshold value ThA, so the multifeed detector 155 mistakenly determines that a multifeed of papers has occurred. Note that, even if sufficiently thick, high rigidity thick paper has been conveyed, an ultrasonic signal which has characteristics similar to the case where a plastic card is conveyed is detected, so the multifeed detector 155 is liable to mistakenly determine that a multifeed of papers has occurred.

The multifeed detector 155 determines that multifeed of the papers has occurred when the signal value of the ultrasonic signal is less than the multifeed detection threshold value (step S503), determines that multifeed of the papers has not occurred when the signal value of the ultrasonic signal is the multifeed detection threshold value or more (step S504), and ends the series of steps.

As explained in detail above, the paper conveying apparatus 100 operates in accordance with the flow charts which are shown in FIG. 4, FIG. 5, and FIG. 6 to thereby determine whether a jam has occurred based on the variation of a frequency signal which is generated from the sound generated by a paper during conveyance, in particular, the unevenness. There are no large peaks in the frequency spectrum of sound which is generated due to a jam, so the paper conveying apparatus 100 can precisely determine whether a jam has occurred.

Figure 11:
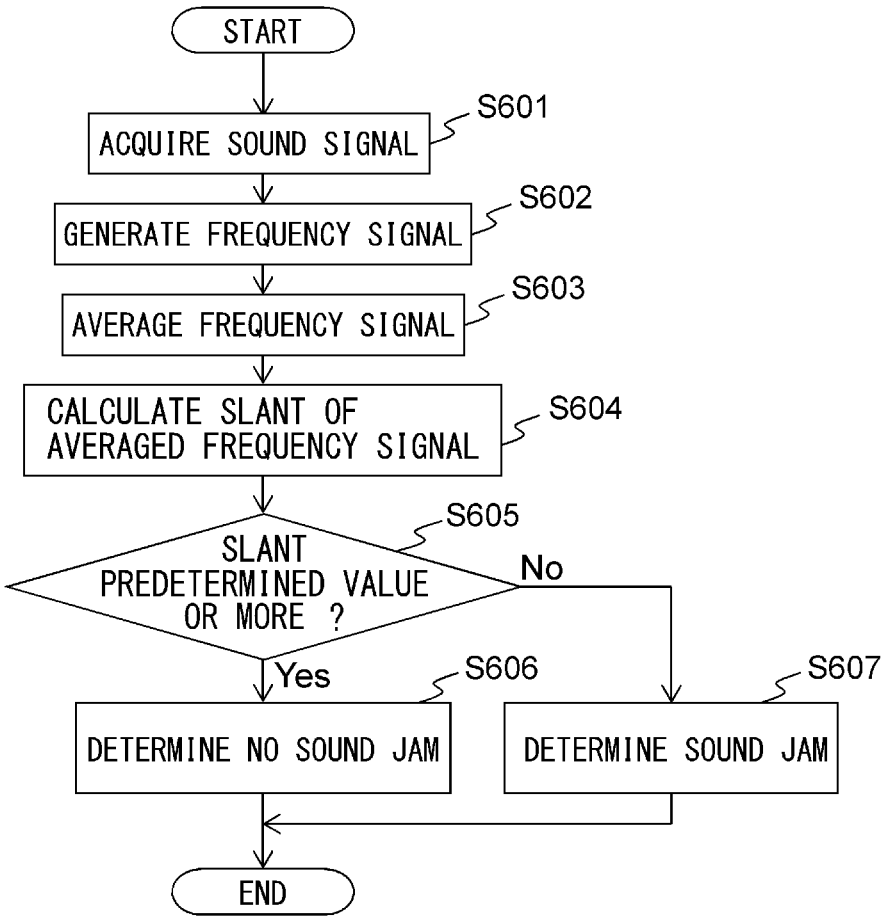
FIG. 11 is a flow chart which shows another example of operation of sound jam detection processing.

FIG. 11 is a flow chart which shows another example of the operations in sound jam detection processing.

This flow chart can be used in the paper conveying apparatus 100 instead of the above-mentioned flow chart which is shown in FIG. 6. In the flow chart which is shown in FIG. 11, unlike the flow chart which is shown in FIG. 6, the sound jam detector 153 calculates a slant of the frequency signal as the variation of the components of the sound signal. The processing of steps S601 to S603 which are shown in FIG. 11 is the same as the processing of steps S301 to S303 which are shown in FIG. 6, so explanations will be omitted. Below, only the processing of steps S604 to S607 will be explained.

At step S604, the sound jam detector 153 calculates the slant of the frequency signal, that is, the slant of the frequency components of the sound signal, as the variation of the components of the sound signal. The "slant" means the degree of reduction between specific components.

The sound jam detector 153 calculates the ratio of the average value of the frequency signal at 100 Hz to 600 Hz (second frequency band) to the average value of the frequency signal at 100 Hz to 200 Hz (first frequency band) as the slant of the frequency signal. Note that, the second frequency band is a frequency band where the lowest frequency is the same as the lowest frequency of the first frequency band and the highest frequency is higher than the highest frequency of the first frequency band. The signal value of a frequency signal is a negative value, so the tendency is shown of the signal value of a frequency signal greatly decreasing along with an increase in frequency the greater the slant.

Next, the sound jam detector 153 determines whether the calculated slant is a predetermined value or more (step S605). The predetermined value is set by previous experiments to a value which enables the slant when a jam has occurred and the slant when a jam has not occurred to be differentiated. In the present case it was made 1.18.

Next, the sound jam detector 153 determines that a sound jam has not occurred when the slant is a predetermined value or more (step S606) and determines that a sound jam has occurred when the slant is less than the predetermined value (step S607), then the series of steps is ended.

In the example which is shown in FIG. 7, the slant of the frequency signal 701 becomes 1.24 and the slant of the frequency signal 702 becomes 1.23, so, for the frequency signal 701 and frequency signal 702, it is determined that no sound jam has occurred. On the other hand, the slant of the frequency signal 703 becomes 1.13, so, for the frequency signal 703, it is determined that a sound jam has occurred.

Further, at step S604, the sound jam detector 153 may calculate the ratio of the average value of the frequency signal at 200 Hz to 600 Hz (second frequency band) to the average value of the frequency signal at 100 Hz to 200 Hz (first frequency band) as the slant of the frequency signal. Note that, in this case, the second frequency band is a frequency band which is higher than the first frequency band. In this case, the predetermined value can be made 1.23.

When calculating the ratio of the average value of the frequency signal at 200 Hz to 600 Hz to the average value of the frequency signal at 100 Hz to 200 Hz as the slant, in the example which is shown in FIG. 7, the slant of the frequency signal 701 becomes 1.30 and the slant of the frequency signal 702 becomes 1.30. For the frequency signal 701 and frequency signal 702, it is determined that no sound jam has occurred. On the other hand, the slant of the frequency signal 703 becomes 1.17, so for the frequency signal 703, it is determined that a sound jam has occurred.

Further, at step S604, the sound jam detector 153 may also subtract from a first average value of the frequency signal at 100 Hz to 200 Hz (first frequency band) a second average value of the frequency signal at 200 Hz to 600 Hz (second frequency band) and calculate the difference as the slant of the frequency signal.

In the calculation of the slant, the above-mentioned values of the first frequency band, second frequency band, predetermined value for comparison with the slant, etc. are not limited to the above-mentioned values and may be suitably changed.

As explained above, in a frequency signal in the case where a plurality of papers are conveyed, specific frequency components will become larger than other frequency components due to the rubbing sound when the papers are separated, so at a frequency band higher than a specific frequency, there will be a tendency for the signal value to be decreased the higher the frequency. On the other hand, if a jam occurs, the sound which is generated due to that jam will mask the rubbing sound. Therefore, in a frequency signal in the case where a jam occurs, the tendency for the signal value to decrease the higher the frequency in a frequency band higher than a specific frequency will not be seen as much as with a frequency signal when a jam has not occurred. Therefore, as explained above, it is possible to precisely determine whether a jam has occurred by using the slant of a frequency signal.

As explained in detail above, the paper conveying apparatus 100 operates in accordance with the flow charts which are shown in FIG. 4, FIG. 5, and FIG. 11 to thereby determine if a jam has occurred based on the slant of a frequency signal which is generated from a sound generated by a paper during conveyance. The frequency spectrum of a sound which is generated due to a jam is small in slant, so the paper conveying apparatus 100 can precisely determine whether a jam has occurred.

Figure 12:
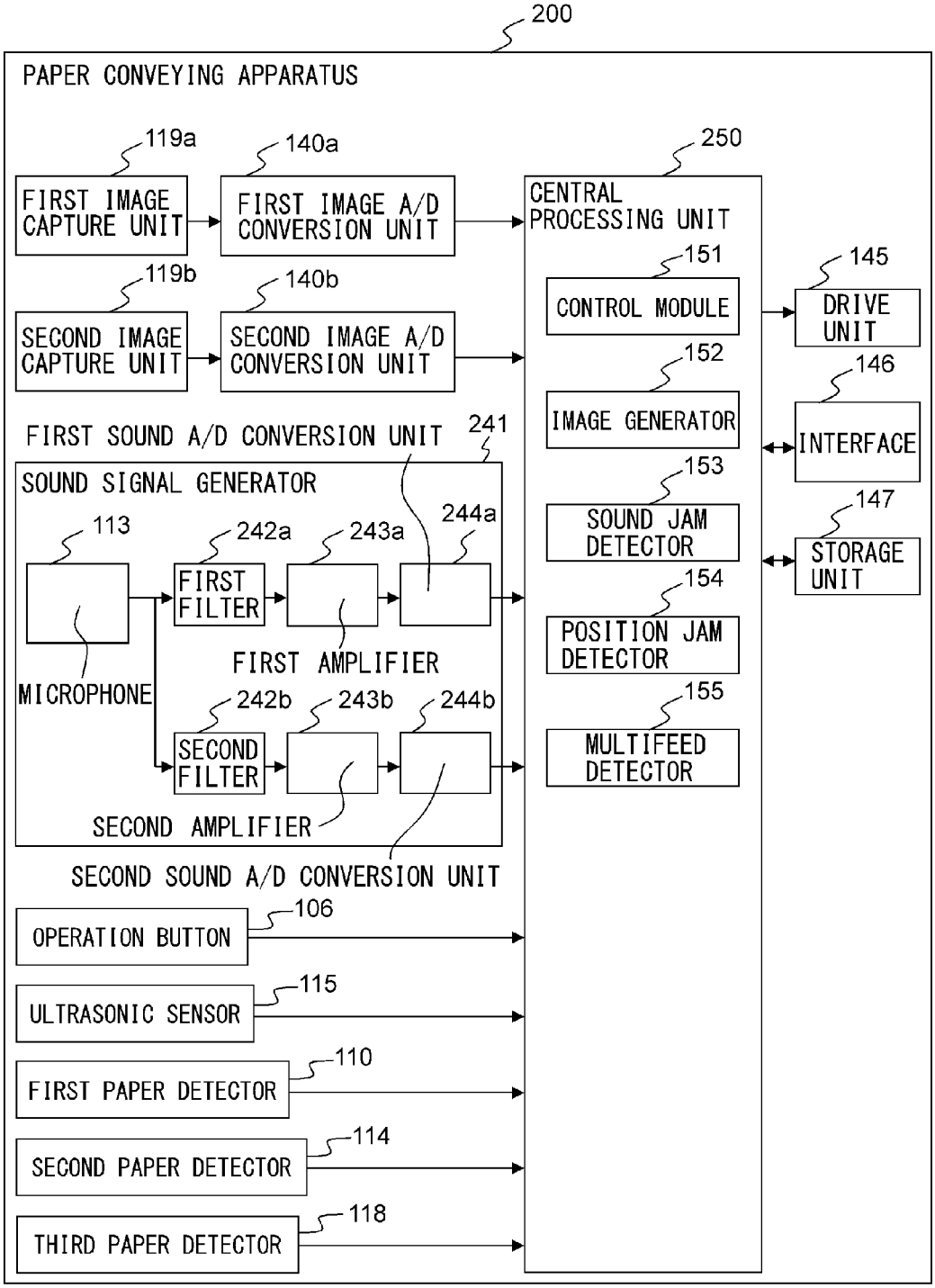
FIG. 12 is a block diagram which shows the schematic configuration of a paper conveying apparatus 200 corresponding to another embodiment.

FIG. 12 is a block diagram which shows the schematic configuration of a paper conveying apparatus 200 according to another embodiment.

The paper conveying apparatus 200 which is shown in FIG. 12 has a sound signal generator 241 instead of the sound signal generator 141 of the paper conveying apparatus 100 which is shown in FIG. 3. Further, the central processing unit 250 does not have a frequency signal generator 156.

The sound signal generator 241 includes a microphone 113, a first filter 242*a*, a second filter 242*b*, a first amplifier 243*a*, a second amplifier 243*b*, a first sound A/D conversion unit 244*a*, a second sound A/D conversion unit 244*b*, etc.

The first filter 242*a* processes the analog signal which is output from the microphone 113 by applying a bandpass filter which passes a signal of a predetermined first frequency band and outputs it to the first amplifier 243*a*. The first amplifier 243*a* amplifies the signal which is output from the first filter 242*a* and outputs it to the first sound A/D conversion unit 244*a*. The first sound A/D conversion unit 244*a* converts the analog signal which is output from the first amplifier 243*a* to a digital signal and outputs it to the central processing unit 250. Below, the signal which is output by the first sound A/D conversion unit 244*a* will be called the "first sound signal".

The second filter 242*b* processes the analog signal which is output from the microphone 113 by applying a bandpass filter which passes a signal of a predetermined second frequency band and outputs it to the second amplifier 243*b*. The second amplifier 243*b* amplifies the signal which is output from the second filter 242*b* and outputs it to the second sound A/D conversion unit 244*b*. The second sound A/D conversion unit 244*b* converts the analog signal which is output from the second amplifier 243*b* to a digital signal and outputs it to the central processing unit 250. Below, the signal which is output by the second sound A/D conversion unit 244*b* will be called the "second sound signal".

The first frequency band is set to a frequency band where the components become larger due to the rubbing sound when papers are separated, while the second frequency band is set to a frequency band higher than the first frequency band.

Figure 13:
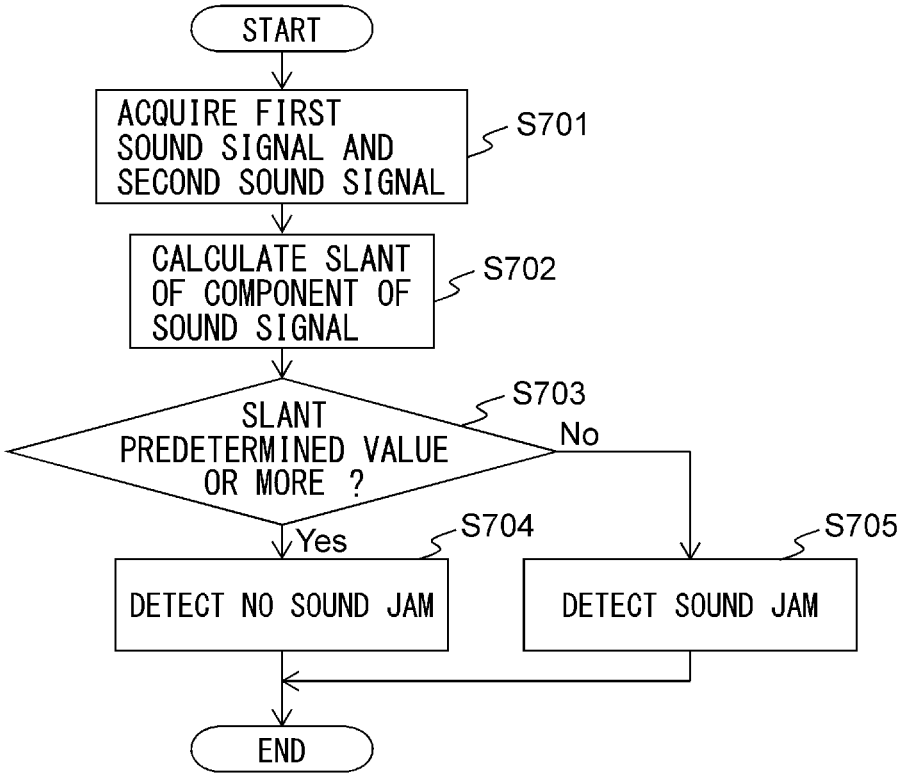
FIG. 13 is a flow chart which shows still another example of the operations in sound jam detection processing.

FIG. 13 is a flow chart which shows still another example of the operations in sound jam detection processing.

This flow chart can be used instead of the above-mentioned flow chart which is shown in FIG. 11 in the paper conveying apparatus 200. In the flow chart which is shown in FIG. 13, unlike the flow chart which is shown in FIG. 11, the sound jam detector 153 calculates the slant of the frequency component of the sound signal based on the first sound signal and second sound signal instead of the slant of the frequency signal. The processing of steps S703 to S705 which are shown in FIG. 13 is the same as the processing of steps S605 to S607 which are shown in FIG. 11, so the explanation will be omitted and, below, only the processing of steps S701 to S702 will be explained.

First, the sound jam detector 153 acquires the first sound signal and second sound signal from the sound signal generator 241 (step S701).

Next, the sound jam detector 153 calculates the slant of the frequency component of the sound signal as the variation of a component of the sound signal. The sound jam detector 153 calculates the ratio of the signal value of the first sound signal to the signal value of the second sound signal as the slant of the frequency component of the sound signal (step S702).

As explained above, when a jam has not occurred, due to the rubbing sound when papers are separated, the tendency becomes stronger for the signal value of the frequency signal to decrease along with an increase of the frequency in a frequency band higher than a specific frequency, while when a jam has occurred, that tendency becomes weaker. That is, for the frequency component of a sound signal, when a jam has not occurred, the tendency for the frequency component to decrease along with an increase in the frequency in a frequency band higher than a specific frequency becomes stronger, while when a jam has occurred, that tendency becomes weaker. Therefore, as explained above, it is possible to precisely determine whether a jam has occurred by utilizing the slant of the frequency component of the sound signal.

As explained in detail above, the paper conveying apparatus 200 calculates the slant of a frequency component of a sound signal based on the ratio of respective signals which were respectively processed using a filter for a frequency band where the components become larger due to the rubbing sound when papers are separated and a filter for a frequency band higher than that. Further, the paper conveying apparatus 200 determines whether a sound jam has occurred based on the calculated slant. Therefore, the paper conveying apparatus 200 becomes able to precisely determine whether a rubbing sound when papers are separated is masking a jam sound and becomes able to precisely determine whether a sound jam has occurred.

Furthermore, the paper conveying apparatus 200 determines whether a sound jam has occurred based on not the values of the sound signal itself, but the ratio of frequency components of the sound signal. In general, the output characteristics of microphones which are provided at different paper conveying apparatuses may vary, but no matter what the output characteristics of one microphone, the frequency components of the sound signal which is output by that microphone will fluctuate uniformly. Therefore, the paper conveying apparatus 200 can reduce the effects of variations in output characteristics of individual microphones and can more precisely determine whether a sound jam has occurred.

Figure 14:
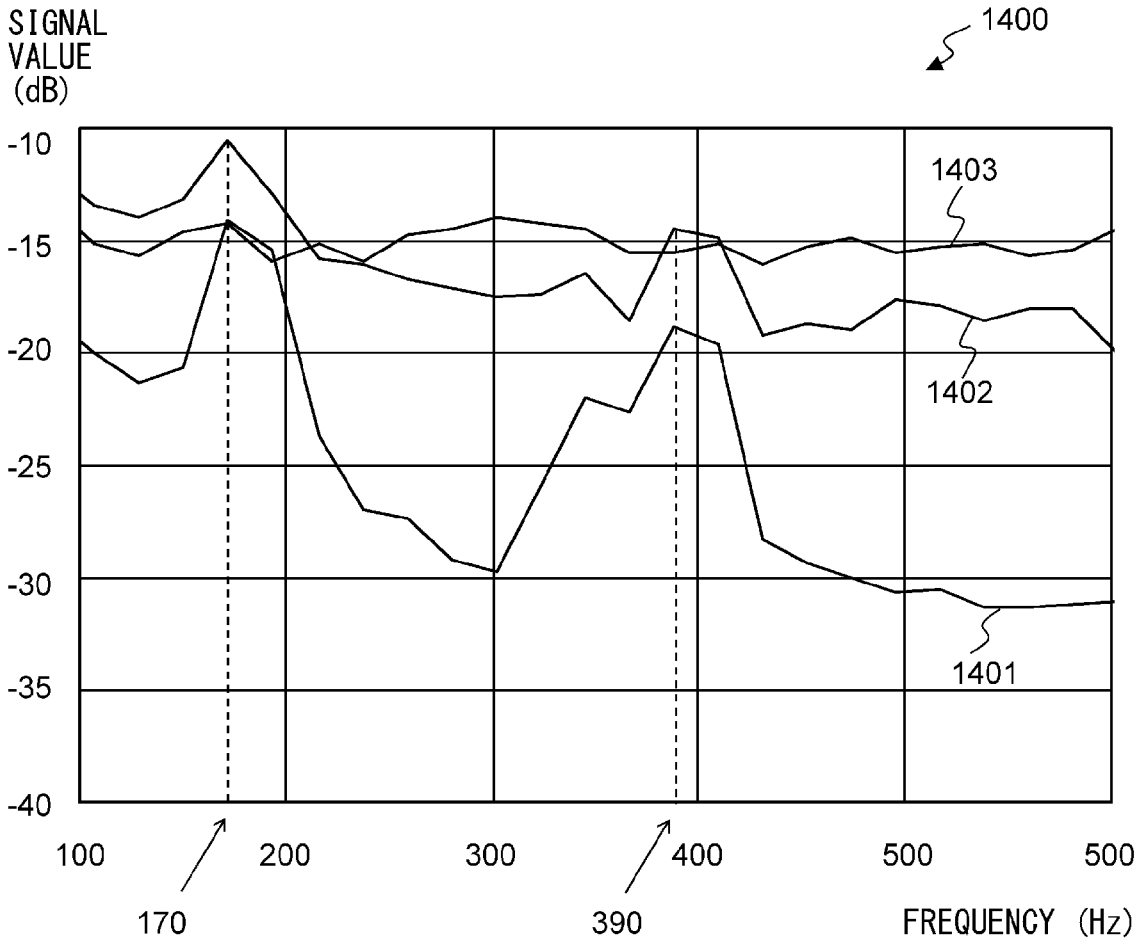
FIG. 14 is a graph which shows an example of a frequency signal when another paper is conveyed.

FIG. 14 is a graph which shows examples of frequency signals when papers of different thickness and paper quality than the case of FIG. 7 are conveyed.

In FIG. 14, the abscissa shows the frequency, while the ordinate shows the signal value of the frequency signal. The graph 1400 of FIG. 14 shows examples of a frequency signal 1401 when normal paper is conveyed, a frequency signal 1402 when wrinkled paper is conveyed, and a frequency signal 1403 when a jam has occurred. The frequency signal 701, frequency signal 702, and frequency signal 703 of FIG. 7 showed the signals which were generated for thin paper of a ream weight of 22 kg. The frequency signal 1401, frequency signal 1402, and frequency signal 1403 of FIG. 14 show signals which were generated for coated paper of a ream weight of 53 kg.

As shown in FIG. 14, the frequency bands where components become larger due to the rubbing sound when coated paper of a ream weight of 53 kg is separated are 170 Hz and 390 Hz or substantially the same as the frequency bands where the components become larger due to the rubbing sound when thin paper of a ream weight of 22 kg is separated. That is, the frequency bands where the components become larger due to the rubbing sound when papers are separated can be determined in advance without depending on the thickness and quality of a paper.

Figure 15:
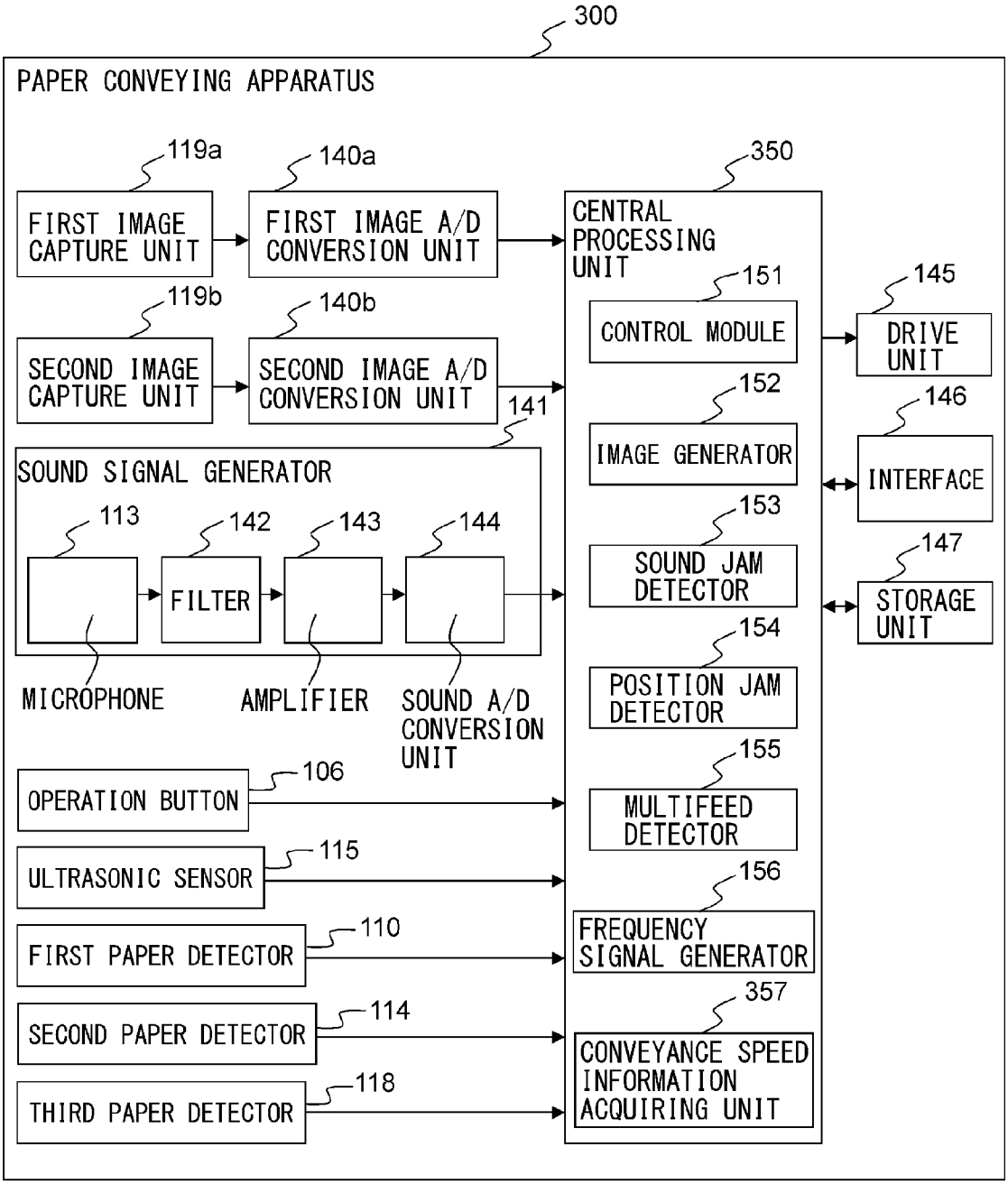
FIG. 15 is a block diagram which shows the schematic configuration of a paper conveying apparatus 300 according to still another embodiment.

FIG. 15 is a block diagram which shows the schematic configuration of a paper conveying apparatus 300 according to still another embodiment.

The central processing unit 350 of the paper conveying apparatus 300 which is shown in FIG. 15 has a conveyance speed information acquiring unit 357 in addition to the parts of the central processing unit 150 of the paper conveying apparatus 100 which is shown in FIG. 3.

The storage unit 147 stores scanning information input by a user. The scanning information includes information about a resolution for scanning a paper. Note that, the scanning information is set from the data processing apparatus 10 through the interface 146.

Figure 16:
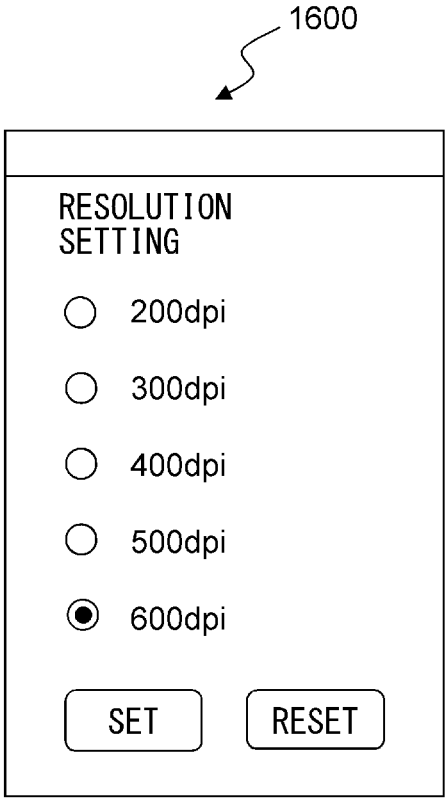
FIG. 16 is a view which shows an example of a screen for setting a resolution for reading a paper.

FIG. 16 shows an example of the screen 1600 for setting the resolution for scanning a paper which the data processing apparatus 10 displays.

As shown in FIG. 16, the setting screen 1600 displays selection buttons for the resolution for scanning a paper to be selected by the user. When the resolution is selected by the user and the set button is pushed, the data processing apparatus 10 transmits resolution information which indicates the selected resolution to the paper conveying apparatus 100. When the interface 146 of the paper conveying apparatus 100 receives the resolution information from the data processing apparatus 10, it sends the received resolution information to the central processing unit 350. The central processing unit 350 stores the resolution information which it received from the interface 146 as scanning information in the storage unit 147 and sets a rotational speed of the drive unit 145 in accordance with that resolution information so as to set the conveyance speed of the paper. The conveyance speed is set to become faster the smaller the resolution and to become slower the larger the resolution. The conveyance speed when the resolution is 200 dpi (dots per inch) is set to 60 ppm (page per minute), while the conveyance speed when the resolution is 600 dpi is set to 15 ppm.

The conveyance speed information acquiring unit 357 reads the resolution information in the scanning information from the storage unit 147 and acquires the conveyance speed information which shows the conveyance speed of the paper which was set by the central processing unit 350 based on the read resolution information.

Figure 17:
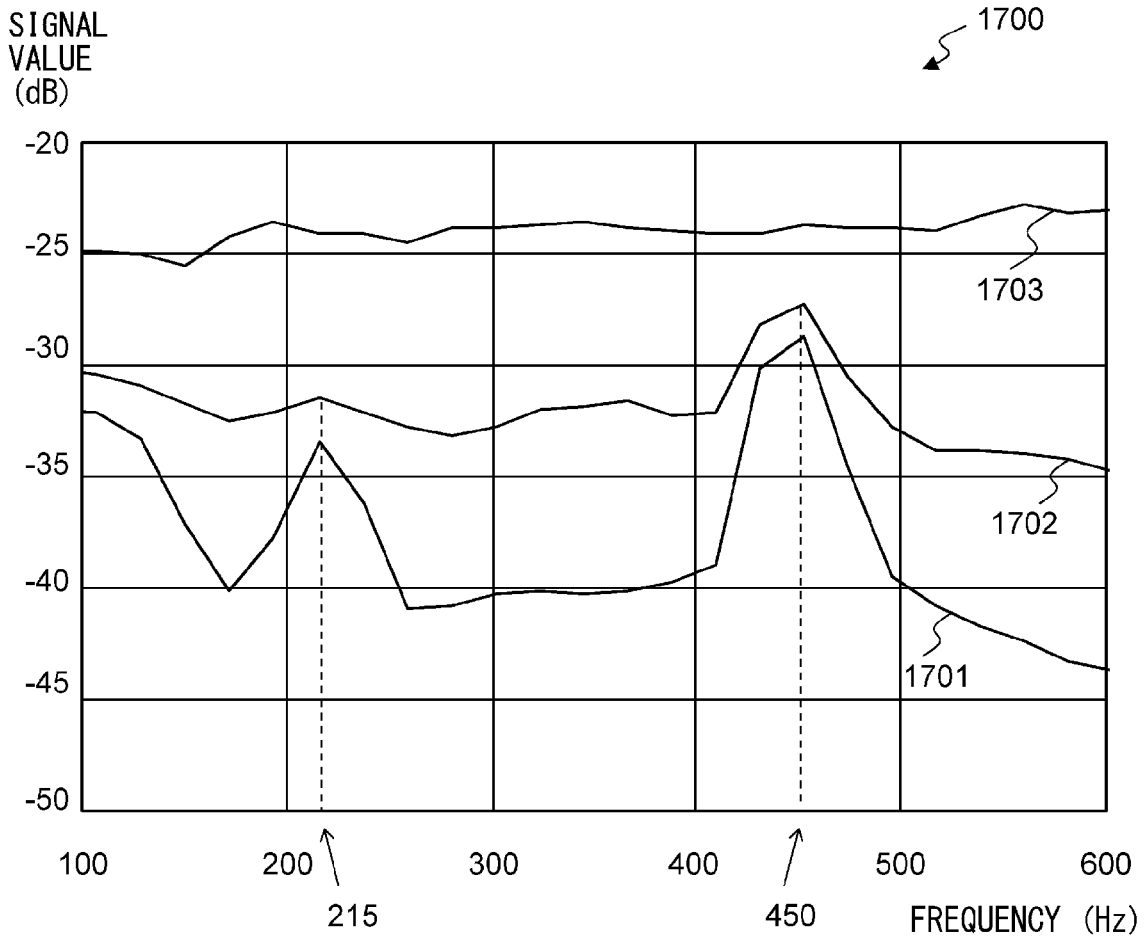
FIG. 17 is a graph which shows examples of frequency signals in the cases of difference conveyance speeds of a paper.

FIG. 17 is a graph which shows examples of frequency signals when the conveyance speed of the paper differs from the case of FIG. 7.

In FIG. 17, the abscissa shows the frequency, while the ordinate shows the signal value of the frequency signal. The graph 1700 of FIG. 17 shows examples of a frequency signal 1701 when normal paper is conveyed, a frequency signal 1702 when wrinkled paper is conveyed, and a frequency signal 1703 when a jam occurs. The frequency signal 701, frequency signal 702, and frequency signal 703 of FIG. 7 showed the signals in the case where the resolution was set to 200 dpi and the paper conveyance speed was set to 60 ppm. The frequency signal 1701, frequency signal 1702, and frequency signal 1703 of FIG. 17 show the signals in the case where the resolution is set to 600 dpi and the paper conveyance speed is set to 16 ppm.

As shown in FIG. 17, the frequency bands where the components become larger when the paper conveyance speed is set to 16 ppm are 215 Hz and 450 Hz or slightly higher than the frequency bands where the components become larger when the paper conveyance speed is set to 60 ppm (170 Hz and 390 Hz). That is, the slower the paper conveyance speed, the higher the frequency bands where the components become larger due to the rubbing sound when papers are separated.

Therefore, experiments are run in advance to investigate at each conveyance speed the frequency band where the components become larger due to the rubbing sound when papers are separated. The conveyance speed information acquiring unit 357 determines the frequency band where the components become larger due to the rubbing sound when papers are separated in accordance with the conveyance speed information.

When calculating the unevenness of a frequency signal by using the signal value of the averaged frequency signal at a predetermined frequency at step S304 of FIG. 6, the sound jam detector 153 uses a signal of the frequency band which the conveyance speed information acquiring unit 357 determines. Similarly, the sound jam detector 153 uses a signal of the frequency band which the conveyance speed information acquiring unit 357 determines even when calculating the slant according to the flow chart of FIG. 11 or the flow chart of FIG. 13.

As explained in detail above, the paper conveying apparatus 300 determines the frequency band where the components become larger due to the rubbing sound which is generated when papers are separated in accordance with the conveyance speed of the paper or the resolution for scanning the paper, so it becomes possible to more precisely determined whether a sound jam has occurred.

According to the paper conveying apparatus and the jam detection method, and the computer-readable, non-transitory medium, the paper conveying apparatus determines whether a jam has occurred based on a variation of a component of the sound generated by a paper during conveyance, so can suppress mistaken detection of the occurrence of a jam.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a sound signal generator, provided with a sound detector near a conveyance path of a paper, for generating a sound signal corresponding to a sound generated by the paper during conveyance of the paper;

a frequency signal generator for generating a frequency signal by converting the sound signal to frequency; and a sound jam detector for determining whether a jam has occurred, based on a sum of differences of values of frequency components of the frequency signal and values of adjoining frequency components which respectively adjoin the frequency components, or based on a difference of a maximum value of the frequency signal and a minimum value of the frequency signal, or based on a difference of a value of the frequency signal at a predetermined frequency and an average value of the frequency signal or a difference of a value of the frequency signal at a predetermined frequency and a minimum value of the frequency signal, or based on a ratio of a first average value of the frequency signal at a first frequency band and a second average value of the frequency signal at a second frequency band which has a minimum frequency the same as a minimum frequency of the first frequency band and which has a maximum frequency higher than a maximum frequency of the first frequency band, or based on a ratio of a third average value of the frequency signal at a third frequency band and a fourth average value of the frequency signal at a fourth frequency band higher than the third frequency band.

2. A paper conveying apparatus comprising:

a sound signal generator, provided with a sound detector near a conveyance path of a paper, for generating a sound signal corresponding to a sound generated by the paper during conveyance of the paper;

a first filter for a first frequency band which is within an audible frequency range, and a second filter for a second frequency band which is within an audible frequency range and higher than the first frequency band; and a sound jam detector for determining whether a jam has occurred based on a ratio of a first sound signal acquired by processing the sound signal by using the first filter for the first frequency band and a second sound signal acquired by processing the sound signal by using the second filter for the second frequency band.

3. A computer-readable, non-transitory medium storing a computer program, wherein the computer program causes a computer to perform a process, the process comprising:

acquiring a sound signal from a sound signal generator, provided with a sound detector near a conveyance path of a paper, for generating the sound signal corresponding to a sound generated by the paper during conveyance of the paper;

acquiring a frequency signal by converting the sound signal to frequency; and determining whether a jam has occurred, based on a sum of differences of values of frequency components at the frequency signal and values of adjoining frequency components which respectively adjoin the frequency components, or based on a difference of a maximum value of the frequency signal and a minimum value of the frequency signal, or based on a difference of a value of the frequency signal at a predetermined frequency and an average value of the frequency signal or a difference of a value of the frequency signal at a predetermined frequency and a minimum value of the frequency signal, or based on a ratio of a first average value of the frequency signal at a first frequency band and a second average value of the frequency signal at a second frequency band which has a minimum frequency the same as a minimum frequency of the first frequency band and which has a maximum frequency higher than a maximum frequency of the first frequency band, or based on a ratio of a third average value of the frequency signal at a third frequency band and a fourth average value of the frequency signal at a fourth frequency band higher than the third frequency band.

4. A computer-readable, non-transitory medium storing a computer program, wherein the computer program causes a computer to perform a process, the process comprising:

acquiring a sound signal from a sound signal generator, provided with a sound detector near a conveyance path of a paper, for generating the sound signal corresponding to a sound generated by the paper during conveyance of the paper; and determining whether a jam has occurred based on a ratio of a first sound signal acquired by processing the sound signal by using a first filter for a first frequency band which is within an audible frequency range, and a second sound signal acquired by processing the sound signal by using a second filter for a second frequency band which is within an audible frequency range and higher than the first frequency band.

* * * * *